US010662493B2

(12) United States Patent
Yuga et al.

(10) Patent No.: US 10,662,493 B2
(45) **Date of Patent: *May 26, 2020**

(54) ABRASION-RESISTANT STEEL PLATE AND METHOD FOR MANUFACTURING THE SAME

(71) Applicant: JFE STEEL CORPORATION, Tokyo (JP)

(72) Inventors: Masao Yuga, Hanada (JP); Shinichi Miura, Kurashiki (JP); Akio Ohmori, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 830 days.

This patent is subject to a terminal disclaimer.

(21) Appl. No.: 15/114,889

(22) PCT Filed: Jan. 26, 2015

(86) PCT No.: PCT/JP2015/000332
§ 371 (c)(1),
(2) Date: Jul. 28, 2016

(87) PCT Pub. No.: WO2015/115086
PCT Pub. Date: Aug. 6, 2015

(65) Prior Publication Data

US 2016/0348208 A1 Dec. 1, 2016

(30) Foreign Application Priority Data

Jan. 28, 2014 (JP) ..... 2014-013297

(51) Int. Cl.

| | |
|---|---|
| ***C21D 9/46*** | (2006.01) |
| ***C22C 38/38*** | (2006.01) |
| ***C22C 38/58*** | (2006.01) |
| ***C21D 8/02*** | (2006.01) |
| ***C21D 1/18*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 9/46* (2013.01); *C21D 1/18* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 8/02* (2013.01); *C21D 2211/001* (2013.01); *C21D 2211/002* (2013.01); *C21D 2211/008* (2013.01)

(58) Field of Classification Search
CPC ..... C21D 9/46
See application file for complete search history.

(56) References Cited

U.S. PATENT DOCUMENTS 7,462,251 B2 * 12/2008 Beguinot ..... C21D 1/19 148/547
7,998,285 B2 * 8/2011 Beguinot ..... C21D 1/19 148/320

(Continued)

FOREIGN PATENT DOCUMENTS

CN 101775545 A * 7/2010
EP 2154262 A1 2/2010

(Continued)

OTHER PUBLICATIONS

Mar. 1, 2017 Office Action issued in Chinese Patent Application No. 201580006234.

(Continued)

*Primary Examiner* — Jessee R Roe
*Assistant Examiner* — Jophy S. Koshy
(74) *Attorney, Agent, or Firm* — Oliff PLC

(57) ABSTRACT

An abrasion resistant steel plate having excellent low-temperature toughness and excellent cracking resistance in a portion which has been heated to a temperature range in which low-temperature temper embrittlement occurs and a method for manufacturing the steel plate. The steel plate includes a microstructure at positions located at ¼ of the thickness and at ¾ of the thickness including a martensite single phase microstructure having an average prior austenaite grain diameter in the range of 20 μm to 60 μm, or a mixed microstructure of martensite and bainite having a proportion of martensite-austenite constituent of less than 5% in terms of area ratio with respect to the whole microstructure.

8 Claims, No Drawings

(56) References Cited

U.S. PATENT DOCUMENTS

| | | | | |
|---|---|---|---|---|
| 9,982,331 | B2 * | 5/2018 | Miura | C22C 38/60 |
| 10,093,998 | B2 * | 10/2018 | Nagao | C22C 38/00 |
| 2008/0156400 | A1 | 7/2008 | Nakashima et al. | |
| 2010/0024926 | A1 | 2/2010 | Nagao et al. | |
| 2012/0199255 | A1 | 8/2012 | Anelli et al. | |

FOREIGN PATENT DOCUMENTS

| | | | |
|---|---|---|---|
| EP | 2 589 675 | A1 | 5/2013 |
| EP | 2 589 676 | A1 | 5/2013 |
| EP | 2 692 890 | A1 | 2/2014 |
| EP | 2 873 748 | A1 | 5/2015 |
| JP | S61-166954 | A | 7/1986 |
| JP | S63-317623 | A | 12/1988 |
| JP | H01-255622 | A | 10/1989 |
| JP | H02-179842 | A | 7/1990 |
| JP | H05-51691 | A | 3/1993 |
| JP | H08-41535 | A | 2/1996 |
| JP | 2002-020837 | A | 1/2002 |
| JP | 2002-080930 | A | 3/2002 |
| JP | 2002-115024 | A | 4/2002 |
| JP | 2003-171730 | A | 6/2003 |
| JP | 2007-119850 | A | 5/2007 |
| JP | 2008-208454 | A | 9/2008 |
| JP | 2009-030092 | A | 2/2009 |
| JP | 2009-030093 | A | 2/2009 |
| JP | 2010-159466 | A | 7/2010 |
| JP | 2011052320 | A | 3/2011 |
| JP | 2011-179122 | A | 9/2011 |
| JP | 2011-214120 | A | 10/2011 |
| JP | 2013-104124 | A | 5/2013 |
| JP | 2013-112890 | A | 6/2013 |
| JP | 2014-194042 | A | 10/2014 |
| KR | 20090102791 | A | 9/2009 |
| KR | 2009-0123006 | A | 12/2009 |
| WO | 2012/133910 | A1 | 10/2012 |

OTHER PUBLICATIONS

Nov. 23, 2017 Notice of Allowance issued in Korean Patent Application No. 10-2016-7023381.

Mar. 10, 2015 International Search Report issued in PCT/JP2015/000332.

Jan. 4, 2017 Search Report issued in European Patent Application No. 15742649.5.

Nov. 22, 2016 Office Action issued in Australian Patent Application No. 2015212260.

Jul. 13, 2017 Office Action issued in Korean Patent Application No. 10-2016-7023381.

Mar. 28, 2018 Office Action issued in U.S. Appl. No. 14/779,576.

Apr. 7, 2017 Office Action issued in U.S. Appl. No. 14/429,499.

Oct. 11, 2017 Office Action issued in U.S. Appl. No. 14/429,499.

* cited by examiner

ABRASION-RESISTANT STEEL PLATE AND METHOD FOR MANUFACTURING THE SAME

This application is a national stage of PCT/JP2015/000332, filed Jan. 26, 2015, which claims priority to Japanese Application No. 2014-013297, filed Jan. 28, 2014. The entire contents of the prior applications are hereby incorporated by reference herein in their entirety.

TECHNICAL FIELD

This application relates to an abrasion-resistant steel plate or steel sheet used for, for example, industrial machines and transporting machines and a method for manufacturing the steel plate or steel sheet. That is, the application relates to a steel plate having excellent low-temperature toughness and resistance to cracking due to delayed fracturing in a portion which has been heated to a low-temperature temper embrittlement occurring temperature region of about 300° C. to 400° C. in a welded heat-affected zone or a heat-affected zone after thermal cutting such as gas cutting or plasma cutting.

BACKGROUND

Since the abrasion resistant property of steel is increased by increasing hardness, steel used for parts which are required to have abrasion resistant property contains C in an amount in accordance with the required hardness and is subjected to a quenching treatment or a quenching and tempering treatment.

When a high-hardness abrasion-resistant steel plate is reheated to temperature region of about 300° C. to 400° C. occurring a low-temperature temper embrittlement as a result of performing, for example, welding, gas cutting, or plasma cutting, cracking may occur due to delayed fracturing after the steel plate has been cooled to room temperature. However, since processing such as welding or gas cutting is indispensable, it is an issue to prevent the above-described cracking. Cracking due to delayed fracturing in a portion which has been reheated to the temperature region occurring a low-temperature temper embrittlement may be referred to as "low-temperature temper embrittlement cracking" or "low-temperature embrittlement cracking" in some cases.

In addition, an abrasion-resistant steel plate may be used in an operation of a low-temperature range of 0° C. or lower, and thus there is a problem of brittle fracturing occurring in use in the case of a low-toughness steel plate. Generally, increasing the amount of C contained in order to increase hardness or adding alloying elements in order to increase hardenability conversely causes a decrease in toughness as a result of the embrittlement of the material. Various techniques have been proposed regarding an abrasion-resistant steel plate.

For example, abrasion-resistant steel plates excellent in delayed fracturing resistance proposed in Patent Literature 1 through Patent Literature 6 are intended to increase the delayed fracturing resistance of a steel plate in the manufactured state without further treatments, and no consideration is given to increasing delayed fracturing resistance in a portion which has been reheated to a temperature in the range in which low-temperature temper embrittlement occurs.

Regarding an abrasion-resistant steel plate excellent in low-temperature toughness, for example, Patent Literature 7, Patent Literature 8, and Patent Literature 9 disclose techniques in which the toughness of an abrasion-resistant steel plate is increased by adding alloying elements such as Cr and Mo in large amounts. In the case of these techniques, Cr is added in order to increase hardenability, and Mo is added in order to increase hardenability and grain boundary strength at the same time. In addition, in Patent Literature 7 and Patent Literature 8, low-temperature toughness is increased by performing a tempering heat treatment.

On the other hand, examples of a technique in which a manufacturing process is devised include one disclosed in Patent Literature 10, and the literature describes that toughness is increased by elongating prior austenite grains through the utilization of ausforming in a hot rolling process. As an example of a technique for inhibiting low-temperature embrittlement cracking, Patent Literature 11 discloses a technique in which martensite is formed as a matrix structure where a prior austenite grain diameter is controlled to be 30 μm or less in order to inhibit cracking and to increase toughness.

CITATION LIST

Patent Literature

PTL 1: Japanese Unexamined Patent Application Publication No. 2002-115024

PTL 2: Japanese Unexamined Patent Application Publication No. 2002-80930

PTL 3: Japanese Unexamined Patent Application Publication No. 5-51691

PTL 4: Japanese Unexamined Patent Application Publication No. 1-255622

PTL 5: Japanese Unexamined Patent Application Publication No. 63-317623

PTL 6: Japanese Unexamined Patent Application Publication No. 2003-171730

PTL 7: Japanese Unexamined Patent Application Publication No. 8-41535

PTL 8: Japanese Unexamined Patent Application Publication No. 2-179842

PTL 9: Japanese Unexamined Patent Application Publication No. 61-166954

PTL 10: Japanese Unexamined Patent Application Publication No. 2002-20837

PTL 11: Japanese Unexamined Patent Application Publication No. 2009-30092

SUMMARY

Technical Problem

However, in the case of the abrasion-resistant steel plates according to Patent Literature 7 through Patent Literature 9, since toughness is increased by increasing grain boundary strength through the addition of alloying elements in large amounts, there is an increase in costs of alloying elements. In the case of abrasion-resistant steel plates according to Patent Literature 7 and Patent Literature 8, since hardness decreases because a tempering heat treatment is performed, a negative effect on abrasion resistant property is unavoidable.

In addition, in the case of the method for manufacturing an abrasion-resistant steel plate according to Patent Literature 10, since ausforming is utilized in a hot rolling process, a finishing delivery temperature is controlled to be low and there is a decrease in manufacturability, and it is necessary to strictly control temperature in order to stably manufacture a steel plate, which means that this is not necessarily a practically easy process.

In the case of the method for manufacturing an abrasion-resistant steel plate according to Patent Literature 11, although there is no detailed description, it is presumed that a steel plate is manufactured by using an energy-intensive process in which reheating and quenching is performed after a rolling process or by using a direct quenching method in order to form a microstructure having a desired grain diameter. In the case of a direct quenching method, it is necessary to strictly control manufacturing conditions so that, for example, rolling is performed at a low temperature and with a large rolling reduction, there is a decrease in rolling efficiency, and a high load is placed on rolling equipment.

In addition, since a decrease in grain diameter is accompanied by an increase in the number of nucleation sites when a transformed microstructure is formed, which results in a decrease in hardenability, there may be an increase in manufacturing costs due to an increase in the amount of alloy chemical elements added in order to achieve satisfactory hardenability.

As described above, a technique for manufacturing an inexpensive abrasion-resistant steel plate having excellent low-temperature toughness, with which it is possible to inhibit delayed fracturing from occurring in a portion which has been heated to a temperature range occurring a low-temperature temper embrittlement due to heat induced by performing welding or thermal cutting and then cooled to room temperature, has not been completed.

Therefore, it is an object of the disclosed embodiments to provide an abrasion-resistant steel plate having an inexpensive chemical composition, excellent low-temperature toughness, and excellent low-temperature temper embrittlement cracking resistance and a method for manufacturing the steel plate. The disclosed embodiments are intended for an abrasion-resistant steel plate having a surface hardness of 350 or more and 450 or less in terms of Brinell hardness (HBW 10/3000).

Solution to Problem

To achieve the object described above, investigations were diligently conducted regarding various factors influencing the low-temperature temper embrittlement cracking resistance and low-temperature toughness of an abrasion-resistant steel plate, and it was found that it is important to decrease the amount of center segregation in a center segregation zone having a high embrittlement sensitivity in a thick steel plate and that it is possible to inhibit low-temperature temper embrittlement cracking by decreasing the amount of P contained to 0.006% or less and by controlling segregation chemical elements.

The disclosed embodiments have been completed on the basis of the obtained knowledge and additional investigations, that is, the disclosed embodiments are as follows.

1. An abrasion-resistant steel plate having a surface hardness of 350 or more and 450 or less in terms of Brinell hardness (HBW 10/3000), the steel plate having:

a chemical composition containing, by mass %, C: 0.100% or more and less than 0.175%, Si: 0.05% or more and 1.00% or less, Mn: 0.50% or more and 1.90% or less, P: less than 0.006%, S: 0.005% or less, Al: 0.005% or more and 0.100% or less, Cr: 0.10% or more and 1.00% or less, Nb: 0.005% or more and 0.024% or less, Ti: 0.005% or more and 0.050% or less, B: 0.0003% or more and 0.0030% or less, N: 0.0010% or more and 0.0080% or less, and the balance being Fe and inevitable impurities, the chemical composition satisfying relational expression (1) and relational expression (2), and a microstructure at positions located at ¼ of the thickness and at ¾ of the thickness including a martensite single phase microstructure having an average prior austenite grain diameter of 20 μm or more and 60 μm or less or a mixed microstructure of martensite and bainite having an average prior austenite grain diameter of 20 μm or more and 60 μm or less and a proportion of martensite-austenite constituent in bainite being less than 5% in terms of area ratio with respect to the whole microstructure.

$$DIH=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\geq 35 \quad (1)$$

$$CES=5.5\times C^{4/3}+75.5\times P+0.90\times Mn+0.12\times Ni+0.53\times Mo\leq 2.70 \quad (2)$$

where in both relational expressions, atomic symbols of the alloying elements denote the contents (mass %) of the corresponding elements, and the contents of the elements which are not contained are defined as 0.

2. The abrasion-resistant steel plate according to item 1, wherein the chemical composition further contains, by mass %, at least one selected from the group consisting of Mo: 0.05% or more and 0.80% or less, V: 0.005% or more and 0.10% or less, Cu: 0.10% or more and 1.00% or less, and Ni: 0.10% or more and 2.00% or less.

3. The abrasion-resistant steel plate according to item 1 or 2, wherein the chemical composition further contains, by mass %, at least one selected from the group consisting of Ca: 0.0005% or more and 0.0040% or less, Mg: 0.0005% or more and 0.0050% or less, and REM: 0.0005% or more and 0.0080% or less.

4. A method for manufacturing an abrasion-resistant steel plate having a surface hardness of 350 or more and 450 or less in terms of Brinell hardness (HBW 10/3000), the method including:

heating a semi-finished product having the chemical composition according to any one of items 1 to 3 to 1050° C. to 1200° C., performing hot rolling with an cumulative rolling reduction of 30% or more at a temperature of 950° C. or higher and an cumulative rolling reduction of 30% or more and 70% or less at a temperature lower than 940° C., finishing hot rolling at a surface temperature of (Ar3+80° C.) or higher and (Ar3+180° C.) or lower, performing quenching from a temperature of Ar3 or more and cooling to a temperature of 300° C. or lower at a cooling rate of 2° C./s or more at a position located at ½ of the thickness, wherein the steel plate manufactured has a microstructure at positions located at ¼ of the thickness and at ¾ of the thickness including a martensite single phase microstructure having an average prior austenite grain diameter of 20 μm or more and 60 μm or less or a mixed microstructure of martensite and bainite having an average prior austenite grain diameter of 20 μm or more and 60 μm or less and martensite-austenite constituent in bainite being less than 5% in terms of area ratio with respect to the whole microstructure.

Advantageous Effects

According to the disclosed embodiments, it is possible to obtain an abrasion-resistant steel plate excellent in terms of delayed cracking resistance in a portion which has been subjected to low-temperature tempering due to heat induced by performing welding or thermal cutting and low-temperature toughness. In addition, it is possible to obtain a method for manufacturing the steel plate with a reduced environment load, which has a marked effect on the industry.

DETAILED DESCRIPTION

In the disclosed embodiments, a chemical composition and a microstructure are specified.

[Chemical Composition]

Hereinafter, % used when describing a chemical composition refers to mass %.

C: 0.100% or more and less than 0.175%

C is an element which increases abrasion resistant property by increasing matrix hardness. In order to achieve abrasion resistant property corresponding to a hardness of 350 or more in terms of Brinell hardness (HBW 10/3000), it is necessary that the C content be 0.100% or more, or preferably 0.120% or more. On the other hand, when the C content is 0.175% or more, there is a decrease in low-temperature temper embrittlement cracking resistance. It is preferable that the C content be 0.160% or less, or more preferably 0.150% or less.

Si: 0.05% or more and 1.00% or less

Si is an element which is effective as a deoxidizing agent, and it is necessary that the Si content be 0.05% or more, or preferably 0.10% or more, in order to realize such an effect. In addition, Si is an effective element which contributes to an increase in hardness through solid solution strengthening as a result of forming a solid solution in steel. However, when the Si content is more than 1.00%, there is a decrease in ductility and toughness, and there is an increase in the amount of inclusions. Therefore, the Si content is limited to 1.00% or less, or preferably 0.45% or less.

Mn: 0.50% or more and 1.90% or less

Mn promotes the occurrence of delayed fracturing by promoting the grain boundary segregation of P. However, according to the disclosed embodiments, by controlling the P content to be less than 0.006%, it is possible to increase hardenability by adding Mn, which is a comparatively inexpensive element. On the other hand, since it is necessary that a certain amount of Mn be added in order to achieve satisfactory hardenability, and since it is preferable that Mn be added from the viewpoint of decreasing alloy costs, the Mn content is limited to be 0.50% or more and 1.90% or less. It is preferable that the lower limit of the Mn content be 0.90%. It is preferable that the upper limit of the Mn content be 1.50%.

P: less than 0.006%

P is segregated at the grain boundaries, and becomes the starting point at which delayed fracturing occurs. In addition, P increases low-temperature temper embrittlement sensitivity by increasing the hardness of a center segregation zone as a result of being concentrated in the center segregation zone. Since there is an increase in low-temperature temper embrittlement cracking resistance in a portion which has been subjected to low-temperature tempering due to heat induced by performing welding or thermal cutting such as gas cutting by controlling the P content to be less than 0.006%, the P content is set to be less than 0.006%.

S: 0.005% or less

S is an impurity which is inevitably mixed in steel, and, when the S content is more than 0.005%, S forms MnS from which fracturing originates. Therefore, the S content is set to be 0.005% or less, or preferably 0.0035% or less.

Al: 0.005% or more and 0.100% or less

Al is an element which is added in order to deoxidize molten steel, and it is necessary that the Al content be 0.005% or more. On the other hand, when the Al content is more than 0.100%, there is a decrease in the cleanliness of steel, and there is a decrease in toughness. Therefore, the Al content is set to be 0.005% or more and 0.100% or less, or preferably 0.010% or more and 0.040% or less.

Cr: 0.10% or more and 1.00% or less

Cr is effective for increasing hardenability, and it is necessary that the Cr content be 0.10% or more in order to realize such an effect. On the other hand, when the Cr content is more than 1.00%, there is a decrease in weldability. Therefore, in the case where Cr is added, the Cr content is limited to be 0.10% or more and 1.00% or less, or preferably 0.10% or more and 0.80% or less.

Nb: 0.005% or more and 0.024% or less

Nb is effective for inhibiting delayed fracturing from occurring by decreasing the grain diameter of a microstructure as a result of being precipitated in the form of carbonitrides or carbides. In order to realize such an effect, it is necessary that the Nb content be 0.005% or more. On the other hand, when the Nb content is more than 0.024%, carbonitrides having a large grain diameter are precipitated, and there is a case where fracturing originates from the precipitates. Therefore, the Nb content is set to be 0.005% or more and 0.024% or less, or preferably 0.010% or more and 0.020% or less.

Ti: 0.005% or more and 0.050% or less

Ti is effective for promoting an increase in the hardenability of B by inhibiting the precipitation of BN as a result of fixing N. In order to realize such an effect, it is necessary that the Ti content be 0.005% or more. On the other hand, when the Ti content is more than 0.050%, there is a decrease in the toughness of the base metal as a result of being precipitated in the form of TiC. Therefore, the Ti content is set to be 0.005% or more and 0.050% or less, or preferably 0.010% or more and 0.020% or less.

B: 0.0003% or more and 0.0030% or less

A small amount of B added significantly increases hardenability. In order to realize such an effect, it is necessary that the B content be 0.0003% or more. In addition, when the B content is less than 0.0003%, since bainite transformation occurs at a high temperature due to an insufficient effect of increasing hardenability, there is a decrease in toughness due to an increase in the amount of martensite-austenite constituent in bainite. It is preferable that the B content be 0.0005% or more, or more preferably 0.0010% or more. On the other hand, in the case where the B content is more than 0.0030%, there is a decrease in weldability. Therefore, the B content is set to be 0.0030% or less, or preferably 0.0020% or less.

N: 0.0010% or more and 0.0080% or less

N is added since N is effective for increasing the toughness of the base metal by decreasing a grain diameter as a result of combining with Al to form precipitates. It is not possible to form a sufficient amount of precipitates for decreasing a grain diameter when the N content is less than 0.0010%, and there is a decrease in the toughness of the base metal and a weld zone when the N content is more than 0.0080%. Therefore, the N content is set to be 0.0010% or more and 0.0080% or less, or preferably 0.0010% or more and 0.0050% or less.

$$DIH=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\geq 35 \quad (1)$$

where in the relational expression, atomic symbols of the alloying elements denote the contents (mass %) of the corresponding elements, and the contents of the elements which are not contained are defined as 0.

In the case where DIH is less than 35, since a hardened depth is less than 10 mm in the thickness direction from the surface of a steel plate, there is a decrease in the service life of an abrasion-resistant steel plate. Therefore, DIH is set to be 35 or more, or preferably 45 or more.

$$CES=5.5\times C^{4/3}+75.5\times P+0.90\times Mn+0.12\times Ni+0.53\times Mo\leq 2.70 \quad (2)$$

where in the relational expression, atomic symbols of the alloying elements denote the contents (mass %) of the corresponding elements, and the contents of the elements which are not contained are defined as 0.

Since a center segregation zone, which exists in a steel plate manufactured by using a continuous casting method, is a portion having a high embrittlement sensitivity in a thick steel plate, it is possible to inhibit low-temperature temper embrittlement cracking by decreasing the amount of center segregation. Relational expression (2) indicates the influence of the constituent chemical elements likely to be concentrated in a center segregation zone and has been empirically obtained. In the case of an abrasion-resistant steel plate having a hardness of 350 or more in terms of Brinell hardness (HBW 10/3000), low-temperature temper embrittlement cracking occurs in a center segregation zone in the case where the value derived by using relational expression (2) is more than 2.70. Therefore, CES is set to be 2.70 or less, or preferably 2.40 or less.

The basic chemical composition of the disclosed embodiments is as described above, and the remainder of the chemical composition consists of Fe and inevitable impurities. In order to further improve the properties, at least one of Mo, V, Cu, Ni, Ca, Mg, and REM are added.

Mo: 0.05% or more and 0.80% or less

Mo is an element which is particularly effective for increasing hardenability. In order to realize such an effect, it is necessary that the Mo content be 0.05% or more. On the other hand, when the Mo content is more than 0.80%, there is a decrease in weldability. Therefore, in the case where Mo is added, it is preferable that the Mo content be limited to 0.05% or more and 0.80% or less, or more preferably 0.05% or more and 0.70% or less.

V: 0.005% or more and 0.10% or less

V is an element which increases hardenability. In order to realize such an effect, it is necessary that the V content be 0.005% or more. On the other hand, when the V content is more than 0.10%, there is a decrease in weldability. Therefore, in the case where V is added, it is preferable that the V content be limited to 0.005% or more and 0.10% or less.

Cu: 0.10% or more and 1.00% or less

Cu is an element which increases hardenability by forming a solid solution, and it is necessary that the Cu content be 0.10% or more in order to realize such an effect. On the other hand, when the Cu content is more than 1.00%, there is a decrease in hot workability. Therefore, in the case where Cu is added, it is preferable that the Cu content be limited to 0.10% or more and 1.00% or less, or more preferably 0.10% or more and 0.50% or less.

Ni: 0.10% or more and 2.00% or less

Ni is an element which increases hardenability by forming a solid solution, and such an effect becomes noticeable in the case where the Ni content is 0.10% or more. On the other hand, when the Ni content is more than 2.00%, there is a significant increase in material costs. Therefore, in the case where Ni is added, it is preferable that the Ni content be limited to 0.10% or more and 2.00% or less, or more preferably 0.10% or more and 1.00% or less.

Ca: 0.0005% or more and 0.0040% or less, Mg: 0.0005% or more and 0.0050% or less, and REM: 0.0005% or more and 0.0080% or less Ca, Mg, and REM inhibit the formation of MnS by combining with S. In order to realize such an effect, it is necessary that the content of each of these chemical elements be 0.0005% or more. However, in the case where the Ca content is more than 0.0040%, where the Mg content is more than 0.0050%, or where the REM content is more than 0.0080%, there is a decrease in the cleanliness of steel. Therefore, in the case where these chemical elements are added, the Ca content is set to be 0.0005% or more and 0.0040% or less, the Mg content is set to be 0.0005% or more and 0.0050% or less, and the REM content is set to be 0.0005% or more and 0.0080% or less.

[Microstructure]

The abrasion-resistant steel plate according to the disclosed embodiments has a microstructure at positions located at ¼ of the thickness and ¾ of the thickness including a martensite single phase microstructure having an average prior austenite grain diameter of 20 μm or more and 60 μm or less or a mixed microstructure of martensite and bainite having an average prior austenite grain diameter of 20 μm or more and 60 μm or less. In order to achieve uniform abrasion resistant property in the thickness direction, the microstructure at positions located at ¼ of the thickness and at ¾ of the thickness is specified. Moreover, in order to achieve excellent low-temperature toughness, a martensite single phase microstructure having an average prior austenite grain diameter of 20 μm or more and 60 μm or less or a mixed microstructure of martensite and bainite having an average prior austenite grain diameter of 20 μm or more and 60 μm or less are formed and the proportion of martensite-austenite constituent in bainite is set to be less than 5% in terms of area ratio with respect to the whole microstructure. Here, in both the cases of martensite and bainite, the average prior austenite grain diameter is set to be 20 μm or more and 60 μm or less.

Martensite Single Phase Microstructure or a Mixed Microstructure of Martensite and Bainite The abrasion-resistant steel plate according to the disclosed embodiments has a microstructure at positions located at ¼ of the thickness and ¾ of the thickness including a martensite single phase microstructure or a mixed microstructure of martensite and bainite. Such a microstructure is formed in order to achieve satisfactory abrasion resistant property by achieving a surface hardness of 350 or more in terms of Brinell hardness (HBW 10/3000). Since martensite has a high hardness, it is preferable to form a martensite single phase microstructure from the viewpoint of achieving satisfactory abrasion resistant property and inhibiting the formation of martensite-austenite constituent described below. In addition, since bainite also has a high hardness and excellent abrasion resistant property, and since bainite has higher toughness than martensite, a mixed microstructure of martensite and bainite may be formed.

Average prior austenite grain diameter: 20 μm or more and 60 μm or less

"Prior austenite grain diameter" refers, in the disclosed embodiments, to an austenite grain diameter immediately before the austenite transforms into martensite or bainite due to a quenching treatment. Since austenite grain boundaries function as the nucleation sites of ferrite transformation, when an austenite grain diameter is small and thus the area of austenite grain boundaries is large, ferrite transformation tends to occur, which decreases hardenability. Therefore, when the average prior austenite grain diameter is less than 20 μm, since there is a decrease in hardenability, it is not possible to achieve the desired hardness. Therefore, the average prior austenite grain diameter is set to be 20 μm or more.

In addition, martensite and bainite are transformation-formed phases which are formed through transformation from austenite in a shear displacive manner without involving long-range diffusion of atoms. Therefore, since austenite grain boundaries before transformation occurs is retained in martensite and bainite, the prior austenite grain diameter can easily be determined by performing microstructure observation. Austenite grains are divided into blocks or packets, which are lower structures (laths) having almost the same crystal orientation, through martensite transformation or bainite transformation.

Therefore, when austenite grain diameter is small, the grain diameter of a block or a packet is naturally small. Since a block or a packet corresponds to a fracture facet size in brittle fracturing, when an austenite grain diameter is small, there is an increase in toughness due to a decrease in fracture facet size. In addition, since delayed fracturing in a portion which has been heated to a temperature in the range in which low-temperature temper embrittlement occurs is promoted by the segregation of P at prior austenite grain boundaries, low-temperature temper embrittlement cracking resistance also increases as a prior austenite grain diameter decreases, that is, as P concentration at grain boundaries decreases due to an increase in the area of grain boundaries.

Therefore, from the viewpoint of toughness and low-temperature temper embrittlement cracking resistance, it is preferable that the average prior austenite grain diameter be as small as possible. However, according to the disclosed embodiments, since the P content is limited to less than 0.006%, and since the amounts of segregation chemical elements are controlled by using a CES value, it is possible to achieve sufficient toughness and low-temperature temper embrittlement cracking resistance, even in the case where the average prior austenite grain diameter is 20 μm or more. However, when the average prior austenite grain diameter is more than 60 μm, it is not possible to achieve sufficient toughness or low-temperature temper embrittlement cracking resistance. Therefore, the average prior austenite grain diameter is set to be 60 μm or less, or preferably 40 μm or less.

Martensite-Austenite Constituent: Area Ratio with Respect to the Whole Microstructure of Less than 5%

Generally, martensite-austenite constituent is formed mainly in a bainite microstructure. When the bainite transformation temperature is high, there is a case where martensite-austenite constituent (MA) is formed between bainite laths or grain boundaries. When martensite-austenite constituent is formed, since a ductility-brittleness transition temperature in a Charpy impact test is raised, it is not possible to achieve sufficient low-temperature toughness. Therefore, the area ratio of martensite-austenite constituent with respect to the whole microstructure is set to be less than 5%. Since martensite-austenite constituent decreases toughness, it is preferable that the amount of martensite-austenite constituent be as small as possible, and the amount may be absolutely zero.

[Surface Hardness]

When the surface hardness of a steel plate is less than 350 in terms of Brinell hardness (HBW 10/3000), since there is an insufficient impact abrasion resistant property, there is a decrease in the service life of an abrasion-resistant steel plate. Therefore, the surface hardness is set to be 350 or more in terms of Brinell hardness (HBW 10/3000). With this method, it is possible to achieve sufficient abrasion resistance. However, when the surface hardness of a steel plate is more than 450 in terms of Brinell hardness (HBW 10/3000), since there is an increase in low-temperature temper embrittlement cracking sensitivity, low-temperature temper embrittlement cracking tends to occur. Therefore, the surface hardness is set to be 450 or less (HBW 10/3000).

[Manufacturing Method]

The abrasion-resistant steel plate according to the disclosed embodiments is manufactured by preparing molten steel having the chemical composition described above by using an ordinary method using, for example, a steel converter, an electric furnace, or a vacuum melting furnace, by subsequently performing a continuous casting process in order to manufacture a steel material (slab), and then by performing hot rolling.

Slab Heating Temperature: 1050° C. or Higher and 1200° C. or Lower

In the case of the disclosed embodiments, the heating temperature when rolling is performed has only a little influence on the mechanical properties of a steel plate. However, in the case of a thick material, if the heating temperature is excessively low, or if rolling reduction is not sufficiently large, since initial defects, which are formed when a steel material is manufactured, are retained in the central portion in the thickness direction, there is a significant decrease in the internal material properties of a steel plate. In order to certainly press off cast defects, which exist in a slab, with pressure by performing hot rolling, the heating temperature is set to be 1050° C. or higher. However, in the case where the heating temperature is excessively high, there is a decrease in the toughness of the base metal and a weld zone due to an increase in the grain diameter of precipitates such as TiN, which are precipitated at the time of solidification; thick scale is formed on the surface of a slab due to a high temperature, which results in surface defects occurring when rolling is performed; and there is a problem from the viewpoint of energy saving. Therefore, the heating temperature is set to be 1200° C. or lower. Here, according to the disclosed embodiments, "slab heating temperature" refers to the surface temperature of a slab.

Cumulative rolling reduction in a temperature range of 950° C. or higher: 30% or more and cumulative rolling reduction in a temperature range lower than 940° C.: 30% or more and 70% or less Hot rolling is performed with a cumulative rolling reduction in a temperature range of 950° C. or higher of 30% or more and a cumulative rolling reduction in a temperature range lower than 940° C. of 30% or more and 70% or less. When the cumulative rolling reduction in the temperature range of 950° C. or higher is less than 30%, it is difficult to obtain a steel plate having a target thickness by subsequently performing rolling on a slab in the temperature range lower than 940° C. with a cumulative rolling reduction of 70% or less, which is within the range according to the disclosed embodiments. Therefore, the cumulative rolling reduction in the temperature range of 950° C. or higher is set to be 30% or more. In addition, in a high temperature range of 950° C. or higher, the diffusion of chemical elements is promoted by dislocations introduced by performing rolling. Therefore, also, in order to decrease the amount of center segregation, it is preferable that the cumulative rolling reduction in the high temperature range of 950° C. or higher be 30% or more. When the cumulative rolling reduction in the temperature range lower than 940° C. is less than 30%, it is not possible to achieve a target average prior austenite grain diameter of 60 μm or less. Therefore, the cumulative rolling reduction is set to be 30% or more in the temperature range lower than 940° C. In addition, when the cumulative rolling reduction in the temperature range lower than 940° C. is more than 70%, it is not possible to achieve a target average prior austenite grain diameter of 20 μm or more. Therefore, the cumulative rolling reduction is set to be 70% or less in the temperature range lower than 940° C.

Finishing delivery temperature: (Ar3+80° C.) or higher and (Ar3+180° C.) or lower Hot rolling is finished at a temperature of (Ar3+80° C.) or higher and (Ar3+180° C.) or lower in terms of the surface temperature of a steel plate. When the surface temperature of a steel plate is lower than (Ar3+80° C.), it is difficult to stably control a cooling start temperature in the next quenching process to be equal to or higher than the Ar3 temperature. When the cooling start temperature in the quenching process is lower than the Ar3 temperature, since there is a decrease in hardness due to the formation of ferrite, it is not possible to achieve the target surface hardness. In addition, when the finishing delivery temperature is higher than (Ar3+180° C.), since there is an increase in prior austenite grain diameter so that the grain diameter is more than 60 μm, there is a decrease in toughness. Here, it is possible to determine the Ar3 temperature by taking a thermal expansion test sample from each of steel grades and by observing a thermal expansion curve during cooling from a temperature at which austenite is formed.

Cooling Rate: 2° C./s or More and Cooling Stop Temperature: 300° C. or Lower

Quenching is started at a temperature equal to or higher than the Ar3 temperature immediately after hot rolling has been performed, and cooling is performed to a temperature of 300° C. or lower in terms of the temperature at a position located at ½ of the thickness at a cooling rate of 2° C./s or more at a position located at ½ of the thickness of a steel plate. When the cooling rate at a position located at ½ of the thickness of the steel plate is less than 2° C./s, since the proportion of martensite-austenite constituent (MA) is increased to 5% or more in terms of area ratio with respect to the whole microstructure at positions located at ¼ of the thickness and at ¾ of the thickness, there is a decrease in low-temperature toughness. Therefore, the cooling rate at a position located at ½ of the thickness of the steel plate is set to be 2° C./s or more, or preferably 5° C./s or more. Here, although it is not necessary to put a particular limitation on the upper limit of the cooling rate described above, it is preferable that the upper limit be 100° C./s or less, which is within a realizable range of a cooling rate. In addition, in the case where cooling is stopped at a position located at ½ of the thickness at a temperature higher than 300° C., it is not possible to form martensite microstructure in the central portion in the thickness direction, and there is a decrease in toughness due to an increase in the amount of MA formed in bainite. In addition, since the amount of martensite-austenite constituent (MA) is increased to 5% or more in terms of area ratio with respect to the whole microstructure at positions located at ¼ of the thickness and at ¾ of the thickness, there is a decrease in low-temperature toughness.

Here, it is possible to derive the temperature at a position located at ½ of the thickness, from the thickness, the surface temperature, the cooling conditions, and the like by using, for example, a simulation calculation. For example, it is possible to derive the temperature at a position located at ½ of the thickness by calculating a temperature distribution in the thickness direction by using a difference method.

Examples

By performing continuous casting in order to manufacture slabs of steels A through M having the chemical compositions given in Table 1, and by performing hot rolling under the conditions given in Table 2, steel plates having a thickness of 25 mm to 60 mm were manufactured. The Ar3 temperatures of these steels are also given in table 2. Water cooling (direct-quenching: DQ) was performed immediately after rolling had been performed under the conditions given in Table 2. Microstructure observation, the determination of prior austenite grain diameter, the determination of an MA proportion, the determination of surface hardness, a Charpy impact test, and a low-temperature temper embrittlement cracking test were performed on the obtained steel plates by using the methods described below.

[Microstructure Observation]

By taking a test piece for microstructure observation from each of the positions located at ¼ of the thickness and at ¾ of the thickness of the obtained steel plate so that the observed surface was a cross section parallel to the rolling direction, by performing mirror polishing, and by performing nital etching, a microstructure was exposed. Subsequently, three fields of view were randomly observed by using an optical microscope at a magnification of 400 times in order to obtain photographs, and then the kinds (such as phases) of metallurgical microstructures were identified by performing a visual test.

[Determination of Prior Austenite Grain Diameter]

Moreover, by performing mirror polishing again on the same test piece for microstructure observation as used for the microstructure observation described above, and by performing etching on the polished test piece with picric acid, prior austenite grain boundaries were exposed in order to determine a prior austenite grain diameter. By performing observation using an optical microscope at a magnification of 400 times, and by determining the circle-equivalent grain diameter of each of 100 prior austenite grains, a prior austenite grain diameter was defined as the average value of the determined circle-equivalent grain diameters.

[MA Proportion]

Moreover, by performing mirror polishing again on the same test piece for microstructure observation as used for the microstructure observation described above, by performing two-step etching in order to expose martensite-austenite constituent (MA), and by tracing the photograph of the portion in which bainite microstructure was formed obtained by using a SEM at a magnification of 2000 times, the proportion of MA was calculated by using an image analysis. Here, "proportion of MA" refers to the area ratio of MA with respect to the whole microstructure.

[Determination of Surface Hardness]

In accordance with JIS Z 2243 (1998), the surface hardness beneath the surface layer was determined. The determination was performed with a tungsten hard ball having a diameter of 10 mm and with a load of 3000 kgf.

[Charpy Impact Test]

By taking a test piece from each of the positions located at ¼ of the thickness and at ¾ of the thickness in accordance with JIS Z 2242, the test was performed at a temperature of −40° C. The target average value of the absorbed energies of the test piece at the positions located at ¼ of the thickness and at ¾ of the thickness was set to be 50 J or more.

[Low-Temperature Temper Embrittlement Cracking Test]

By taking a Charpy impact test piece in accordance with the prescription in JIS Z 2242 from the central portion in the thickness direction including a center segregation zone, by performing a heat treatment at a temperature of 400° C. for 10 minutes, and by performing a Charpy impact test at a temperature of −196° C., the fracture surface was observed. A case where an intergranular fracture surface was recognized in a portion of the fracture surface was judged as a case of a high low-temperature temper embrittlement sensitivity. The obtained results are given in Table 3.

In the case of examples No. 1 and No. 9 through No. 15, which were manufactured by using steels A through F within the range according to the disclosed embodiments and under the manufacturing conditions within the range according to the disclosed embodiments, good surface hardness and low-temperature toughness were achieved, and an intergranular fracture surface was not recognized in the low-temperature temper embrittlement cracking test.

Examples No. 2 through No. 8 were manufactured by using steels A within the range according to the disclosed embodiments and under the manufacturing conditions out of the range according to the disclosed embodiments. In the case of example No. 2 where the cumulative rolling reduction in a temperature range of 950° C. or higher was less than the range according to the disclosed embodiments and where the cumulative rolling reduction in a temperature range lower than 940° C. was more than the range according to the disclosed embodiments, the surface hardness did not satisfy the target value. In the case of example No. 3 where the cumulative rolling reduction in a temperature range lower than 940° C. was more than the range according to the disclosed embodiments, the surface hardness did not satisfy the target value. In the case of example No. 4 where the cumulative rolling reduction in a temperature range lower than 940° C. was less than the range according to the disclosed embodiments, the low-temperature toughness did not satisfy the target value, and an intergranular fracture surface was recognized in the low-temperature temper embrittlement cracking test. In the case of example No. 5 where the finishing delivery temperature of hot rolling was higher than the range according to the disclosed embodiments, the low-temperature toughness did not satisfy the target value, and an intergranular fracture surface was recognized in the low-temperature temper embrittlement cracking test. In the case of example No. 6 where the finishing delivery temperature of hot rolling was lower than the range according to the disclosed embodiments and where, therefore, the cooling start temperature was also lower than the Ar3 temperature, the surface hardness did not satisfy the target value. In the case of example No. 7 where the cooling rate after hot rolling had been performed was less than the range according to the disclosed embodiments, the low-temperature toughness did not satisfy the target value. In the case of example No. 8 where the cooling stop temperature was higher than the range according to the disclosed embodiments, the low-temperature toughness did not satisfy the target value.

In the case of examples No. 16 and No. 17, steels G and H containing C in an amount out of the range according to the disclosed embodiments were respectively used. In the case of example No. 16, the surface hardness did not satisfy the target value. In the case of example No. 17, an intergranular fracture surface was recognized in the low-temperature temper embrittlement cracking test. In the case of example No. 18 where steel I containing P in an amount out of the range according to the disclosed embodiments was used, and in the case of example No. 19 where steel J containing Mn in an amount out of the range according to the disclosed embodiments was used, an intergranular fracture surface was recognized in the low-temperature temper embrittlement cracking test.

In the case of example No. 20 where steel K containing B in an amount out of the range according to the disclosed embodiments was used, and in the case of example No. 21 where steel L having a DIH value out of the range according to the disclosed embodiments was used, the low-temperature toughness was low. In the case of example No. 22 where steel M having a CES value out of the range according to the disclosed embodiments was used, an intergranular fracture surface was recognized in the low-temperature temper embrittlement cracking test.

TABLE 1

| Steel | C | Si | Mn | P | S | Cu | Ni | Cr | Mo | V | Nb | Ti | B |
|---|---|---|---|---|---|---|---|---|---|---|---|---|---|
| A | 0.150 | 0.42 | 1.82 | 0.003 | 0.002 | | | 0.25 | | | 0.017 | 0.015 | 0.0013 |
| B | 0.172 | 0.44 | 1.06 | 0.005 | 0.002 | | 0.25 | 0.16 | 0.19 | | 0.012 | 0.008 | 0.0013 |
| C | 0.120 | 0.21 | 1.75 | 0.002 | 0.001 | 0.49 | | 0.19 | 0.16 | | 0.018 | 0.013 | 0.0012 |
| D | 0.148 | 0.13 | 1.83 | 0.004 | 0.003 | 0.15 | 0.88 | 0.44 | | 0.048 | 0.015 | 0.011 | 0.0010 |
| E | 0.148 | 0.32 | 0.95 | 0.005 | 0.003 | 0.14 | 0.85 | 0.46 | 0.08 | | 0.014 | 0.013 | 0.0011 |
| F | 0.131 | 0.29 | 1.23 | 0.002 | 0.002 | | | 0.74 | 0.28 | 0.054 | 0.024 | 0.012 | 0.0014 |
| G | 0.095 | 0.31 | 1.42 | 0.004 | 0.002 | | | 0.65 | | | 0.011 | 0.011 | 0.0011 |
| H | 0.188 | 0.35 | 1.62 | 0.005 | 0.002 | | | 0.10 | | | 0.020 | 0.012 | 0.0012 |
| I | 0.146 | 0.34 | 1.84 | 0.008 | 0.002 | 0.36 | | 0.48 | | | 0.016 | 0.011 | 0.0012 |
| J | 0.158 | 0.35 | 1.95 | 0.002 | 0.002 | | | 0.45 | | | 0.010 | 0.011 | 0.0013 |
| K | 0.131 | 0.30 | 1.17 | 0.002 | 0.002 | | | 0.12 | 0.25 | | 0.019 | 0.010 | 0.0002 |
| L | 0.128 | 0.12 | 1.15 | 0.003 | 0.001 | 0.05 | 0.05 | 0.15 | 0.05 | 0.016 | 0.020 | 0.011 | 0.0011 |
| M | 0.150 | 0.21 | 1.90 | 0.005 | 0.002 | | 1.15 | 0.15 | 0.32 | | 0.017 | 0.015 | 0.0013 |

| Steel | Al | N | Ca | Mg | REM | DIH | CES | Class |
|---|---|---|---|---|---|---|---|---|
| A | 0.025 | 0.0035 | | | | 58 | 2.30 | Example |
| B | 0.016 | 0.0029 | | | | 81 | 1.99 | Example |
| C | 0.032 | 0.0033 | 0.0012 | | | 71 | 2.14 | Example |
| D | 0.031 | 0.0035 | | 0.0021 | | 84 | 2.31 | Example |
| E | 0.032 | 0.0034 | | | 0.0013 | 63 | 1.77 | Example |
| F | 0.029 | 0.0032 | | | | 120 | 1.76 | Example |
| G | 0.035 | 0.0035 | | | | 55 | 1.82 | Comparative Example |
| H | 0.032 | 0.0034 | | | | 43 | 2.34 | Comparative Example |
| I | 0.024 | 0.0032 | | | | 74 | 2.36 | Comparative Example |
| J | 0.025 | 0.0024 | | | | 78 | 2.38 | Comparative Example |

TABLE 1-continued

| | | | | | |
|---|---|---|---|---|---|
| K | 0.029 | 0.0032 | 51 | 1.70 | Comparative Example |
| L | 0.033 | 0.0033 | 32 | 1.65 | Comparative Example |
| M | 0.025 | 0.0035 | 128 | 2.83 | Comparative Example |

Annotation 1: An underlined portion indicates a value out of the range according to the disclosed embodiments Annotation 2:

$DIH = 33.85 \times (0.1 \times C)^{0.5} \times (0.7 \times Si + 1) \times (3.33 \times Mn + 1) \times (0.35 \times Cu + 1) \times (0.36 \times Ni + 1) \times (2.16 \times Cr + 1) \times (3 \times Mo + 1) \times (1.75 \times V + 1)$ $CES = 5.5 \times C^{4/3} + 75.5 \times P + 0.90 \times Mn + 0.12 \times Ni + 0.53 \times Mo$

TABLE 2

| No. | Steel | Ar3 (° C.) | Slab Heating Temperature (° C.) | Cumulative Rolling Reduction (950° C. or Higher) (%) | Cumulative Rolling Reduction (Lower than 940° C.) (%) | Hot Rolling Finishing Delivery Temperature (° C.) | Cooling Start Temperature (° C.) | Cooling Rate (° C./s) | Cooling Stop Temperature (° C.) | Thickness (mm) | Class |
|---|---|---|---|---|---|---|---|---|---|---|---|
| 1 | A | 714 | 1150 | 60 | 65 | 850 | 810 | 17 | 250 | 35 | Example |
| 2 | A | 714 | 1150 | 28 | 81 | 850 | 810 | 17 | 250 | 35 | Comparative Example |
| 3 | A | 714 | 1150 | 40 | 76 | 850 | 810 | 17 | 250 | 35 | Comparative Example |
| 4 | A | 714 | 1150 | 80 | 22 | 850 | 810 | 17 | 250 | 35 | Comparative Example |
| 5 | A | 714 | 1150 | 60 | 55 | 900 | 810 | 18 | 250 | 35 | Comparative Example |
| 6 | A | 714 | 1150 | 60 | 65 | 790 | 700 | 15 | 250 | 35 | Comparative Example |
| 7 | A | 714 | 1150 | 35 | 38 | 850 | 830 | 1 | 250 | 100 | Comparative Example |
| 8 | A | 714 | 1150 | 60 | 65 | 850 | 810 | 18 | 350 | 35 | Comparative Example |
| 9 | B | 741 | 1170 | 70 | 67 | 890 | 880 | 25 | 200 | 25 | Example |
| 10 | B | 741 | 1100 | 60 | 65 | 900 | 880 | 17 | 260 | 35 | Example |
| 11 | C | 707 | 1100 | 60 | 65 | 850 | 820 | 17 | 260 | 35 | Example |
| 12 | D | 676 | 1180 | 60 | 65 | 830 | 800 | 16 | 250 | 35 | Example |
| 13 | E | 738 | 1200 | 60 | 65 | 900 | 880 | 15 | 200 | 35 | Example |
| 14 | F | 739 | 1200 | 60 | 65 | 900 | 880 | 16 | 200 | 35 | Example |
| 15 | F | 739 | 1100 | 60 | 65 | 900 | 870 | 7 | 250 | 60 | Example |
| 16 | G | 757 | 1150 | 60 | 65 | 890 | 850 | 18 | 250 | 35 | Comparative Example |
| 17 | H | 729 | 1150 | 60 | 65 | 860 | 850 | 17 | 250 | 35 | Comparative Example |
| 18 | I | 719 | 1200 | 60 | 65 | 860 | 840 | 17 | 250 | 35 | Comparative Example |
| 19 | J | 698 | 1150 | 60 | 65 | 850 | 840 | 16 | 250 | 35 | Comparative Example |
| 20 | K | 754 | 1150 | 60 | 65 | 900 | 850 | 16 | 250 | 35 | Comparative Example |
| 21 | L | 768 | 1150 | 60 | 65 | 900 | 850 | 16 | 250 | 35 | Comparative Example |
| 22 | M | 620 | 1150 | 60 | 65 | 800 | 780 | 16 | 250 | 35 | Comparative Example |

Annotation: An underlined portion indicates a value out of the range according to the the disclosed embodiments.

TABLE 3

| No. | Microstructure (at ¼ and ¾ of Thickness) | Average Prior Austenite Grain Diameter (μm) | MA Proportion (%) | Surface Hardness (HBW 10/3000) | Charpy/ Absorbed Energy at −40° C. (J) | Low-Temperature Temper Embrittlement Test | Class |
|---|---|---|---|---|---|---|---|
| 1 | M + B | 33 | 2 | 382 | 88 | ○ | Example |
| 2 | M + B | 12 | 3 | 345 | 140 | ○ | Comparative Example |
| 3 | M + B | 16 | 4 | 340 | 134 | ○ | Comparative Example |
| 4 | M | 65 | <1 | 370 | 20 | x | Comparative Example |
| 5 | M | 70 | <1 | 385 | 25 | x | Comparative Example |
| 6 | M + B + F | 35 | 3 | 325 | 55 | ○ | Comparative Example |
| 7 | M + B | 34 | 8 | 350 | 40 | ○ | Comparative Example |
| 8 | B | 33 | 7 | 355 | 38 | ○ | Comparative Example |
| 9 | M + B | 30 | 2 | 411 | 83 | ○ | Example |
| 10 | M + B | 34 | 2 | 357 | 99 | ○ | Example |
| 11 | M | 38 | <1 | 372 | 79 | ○ | Example |
| 12 | M | 29 | <1 | 373 | 107 | ○ | Example |
| 13 | M | 21 | <1 | 381 | 93 | ○ | Example |
| 14 | M | 22 | <1 | 361 | 137 | ○ | Example |

TABLE 3-continued

| No. | Microstructure (at ¼ and ¾ of Thickness) | Average Prior Austenite Grain Diameter (μm) | MA Proportion (%) | Surface Hardness (HBW 10/3000) | Charpy/ Absorbed Energy at −40° C. (J) | Low-Temperature Temper Embrittlement Test | Class |
|---|---|---|---|---|---|---|---|
| 15 | M | 24 | <1 | 357 | 99 | ○ | Example |
| 16 | M | 30 | <1 | 326 | 94 | ○ | Comparative Example |
| 17 | M | 34 | <1 | 427 | 87 | x | Comparative Example |
| 18 | M | 30 | <1 | 370 | 81 | x | Comparative Example |
| 19 | M | 31 | <1 | 383 | 80 | x | Comparative Example |
| 20 | M + B | 41 | 7 | 376 | 17 | ○ | Comparative Example |
| 21 | M + B | 34 | 8 | 345 | 19 | ○ | Comparative Example |
| 22 | M | 36 | <1 | 377 | 82 | x | Comparative Example |

Annotation 1: Low-Temperature Temper Embrittlement Test ○: without intergranular fracture, x: with intergranular fracture surface
Annotation 2: An underlined portion indicates a value out of the range according to the present invention.

The invention claimed is:

1. An abrasion-resistant steel plate having a surface hardness in the range of 350 to 450 in terms of Brinell hardness (HBW 10/3000), the steel plate having a chemical composition comprising:

C: 0.100% or more and less than 0.175%, by mass %;
Si: 0.05% to 1.00%, by mass %;
Mn: 0.50% to 1.90%, by mass %;
P: less than 0.006%, by mass %;
S: 0.005% or less, by mass %;
Al: 0.005% to 0.100%, by mass %;
Cr: 0.10% to 1.00%, by mass %;
Nb: 0.005% to 0.024%, by mass %;
Ti: 0.005% to 0.050%, by mass %;
B: 0.0003% to 0.0030%, by mass %;
N: 0.0010% to 0.0080%, by mass %; and
Fe and incidental impurities, wherein the steel plate includes a microstructure at positions located at ¼ of the thickness of the steel plate and at ¾ of the thickness of the steel plate including a martensite single phase microstructure having an average prior austenite grain diameter in the range of 20 μm to 60 μm, or a mixed microstructure of martensite and bainite having an average prior austenite grain diameter in the range of 20 μm to 60 μm, and martensite-austenite constituent in bainite being less than 5% in terms of area ratio with respect to the whole microstructure, and the chemical composition satisfies relational expression (1) and relational expression (2):

$$DIH=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\geq 35 \quad (1),$$

$$CES=5.5\times C^{4/3}+75.5\times P+0.90\times Mn+0.12\times Ni+0.53\times Mo\geq 2.70 \quad (2),$$

where, in both relational expressions, atomic symbols of the alloying elements denote the contents by mass % of the corresponding elements, and the contents of the elements which are not contained are defined as 0.

2. The abrasion-resistant steel plate according to claim 1, wherein the chemical composition further comprises at least one selected from the group consisting of Mo: 0.05% to 0.80%, by mass %, V: 0.005% to 0.10%, by mass %, Cu: 0.10% to 1.00%, by mass %, and Ni: 0.10% to 2.00%, by mass %.

3. The abrasion-resistant steel plate according to claim 1, wherein the chemical composition further comprises at least one selected from the group consisting of Ca: 0.0005% to 0.0040%, by mass %, Mg: 0.0005% to 0.0050%, by mass %, and REM: 0.0005% to 0.0080%, by mass %.

4. The abrasion-resistant steel plate according to claim 2, wherein the chemical composition further comprises at least one selected from the group consisting of Ca: 0.0005% to 0.0040%, by mass %, Mg: 0.0005% to 0.0050%, by mass %, and REM: 0.0005% to 0.0080%, by mass %.

5. A method for manufacturing an abrasion-resistant steel plate having a surface hardness in the range of 350 to 450 in terms of Brinell hardness (HBW 10/3000), the method comprising:

heating a steel material having a chemical composition to a temperature in the range of 1050° C. to 1200° C., the chemical composition comprising:

C: 0.100% or more and less than 0.175%, by mass %;
Si: 0.05% to 1.00%, by mass %;
Mn: 0.50% to 1.90%, by mass %;
P: less than 0.006%, by mass %;
S: 0.005% or less, by mass %;
Al: 0.005% to 0.100%, by mass %;
Cr: 0.10% to 1.00%, by mass %;
Nb: 0.005% to 0.024%, by mass %;
Ti: 0.005% to 0.050%, by mass %;
B: 0.0003% to 0.0030%, by mass %;
N: 0.0010% to 0.0080%, by mass %; and
Fe and incidental impurities, the chemical composition satisfying relational expression (1) and relational expression (2):

$$DIH=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\geq 35 \quad (1),$$

$$CES=5.5\times C^{4/3}+75.5\times P+0.90\times Mn+0.12\times Ni+0.53\times Mo\leq 2.70 \quad (2),$$

where, in both relational expressions, atomic symbols of the alloying elements denote the contents by mass % of the corresponding elements, and the contents of the elements which are not contained are defined as 0;

performing hot rolling with a cumulative rolling reduction of 30% or more in a temperature range of 950° C. or higher and a cumulative rolling reduction in the range of 30% to 70% in a temperature range lower than 940° C. to form a steel plate;

finishing hot rolling at a surface temperature in the range of (Ar3+80° C.) to (Ar3+180° C.);

performing quenching from a temperature of Ar3 or more and cooling to a temperature of 300° C. or lower at a cooling rate of 2° C./s or more at a position located at ½ of the thickness of the steel plate, wherein the steel plate includes a microstructure at positions located at ¼ of the thickness of the steel plate and at ¾ of the thickness of the steel plate including a martensite single phase microstructure having an average prior austenite grain diameter in the range of 20 μm to 60 μm, or a mixed microstructure of martensite and bainite having an average prior austenite grain diameter in the range of 20 μm to 60 μm, and martensite-austenite constituent in bainite being less than 5% in terms of area ratio with respect to the whole microstructure.

6. The method for manufacturing an abrasion-resistant steel according to claim 5, wherein the chemical composition further comprises at least one selected from the group consisting of Mo: 0.05% to 0.80%, by mass %, V: 0.005% to 0.10%, by mass %, Cu: 0.10% to 1.00%, by mass %, and Ni: 0.10% to 2.00%, by mass %.

7. The method for manufacturing an abrasion-resistant steel according to claim 5, wherein the chemical composition further comprises at least one selected from the group consisting of Ca: 0.0005% to 0.0040%, by mass %, Mg: 0.0005% to 0.0050%, by mass %, and REM: 0.0005% to 0.0080%, by mass %.

8. The method for manufacturing an abrasion-resistant steel according to claim 6, wherein the chemical composition further comprises at least one selected from the group consisting of Ca: 0.0005% to 0.0040%, by mass %, Mg: 0.0005% to 0.0050%, by mass %, and REM: 0.0005% to 0.0080%, by mass %.

* * * * *